US007704174B2

(12) United States Patent
Takada et al.

(10) Patent No.: US 7,704,174 B2
(45) Date of Patent: Apr. 27, 2010

(54) VERTICAL INTERNAL COMBUSTION ENGINE PROVIDED WITH BELT-DRIVE TRANSMISSION MECHANISM

(75) Inventors: Hideaki Takada, Wako (JP); Yutaka Kubota, Wako (JP); Tatsuya Kuroda, Wako (JP); Kazutake Koyama, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 219 days.

(21) Appl. No.: 11/809,875

(22) Filed: Jun. 1, 2007

(65) Prior Publication Data

US 2007/0251479 A1 Nov. 1, 2007

(30) Foreign Application Priority Data

Jun. 5, 2006 (JP) ..... 2006-156682

(51) Int. Cl.
*F01L 1/02* (2006.01)
*F02F 7/00* (2006.01)

(52) U.S. Cl. ..... 474/144; 123/90.31; 123/572; 123/573; 123/574; 123/195 P; 440/88 L; 440/88 R

(58) Field of Classification Search ..... 474/144; 123/90.31, 572–574; 440/84–87, 88 R, 88 L, 440/89 R; *F02B 67/00, 67/06; F01L 1/02*
See application file for complete search history.

(56) References Cited

U.S. PATENT DOCUMENTS 5,722,360 A * 3/1998 Tsunoda et al. ..... 123/195 P
6,302,749 B1 * 10/2001 Tawa et al. ..... 440/76
7,066,134 B2 * 6/2006 Fukuda et al. ..... 123/196 W

FOREIGN PATENT DOCUMENTS

JP 02-275020 11/1990

* cited by examiner

*Primary Examiner*—Robert A Siconolfi
*Assistant Examiner*—San Aung
(74) *Attorney, Agent, or Firm*—Carrier, Blackman & Associates P.C.; Joseph P. Carrier; William D. Blackman

(57) ABSTRACT

A vertical internal combustion engine includes a crankshaft enclosed in a crank chamber, a belt-drive transmission mechanism held in a belt chamber and including a rubber belt for transmitting power of the crankshaft to a camshaft included in a valve train, and a transmission case defining the belt chamber. The transmission case has a lower case between the crank chamber and the belt chamber. The belt has a part extending over the crank chamber, and the lower case is disposed to screen the part of the belt from the crank chamber. The belt is lubricated by oil in oil-containing gas from the crank chamber. Thus the oil containing gas is prevented from excessively contacting the rubber belt, so that the life of the belt is extended.

6 Claims, 4 Drawing Sheets

VERTICAL INTERNAL COMBUSTION ENGINE PROVIDED WITH BELT-DRIVE TRANSMISSION MECHANISM

BACKGROUND OF THE INVENTION

1. Field of the Invention

The present invention relates to a vertical internal combustion engine having a crankshaft held in a crankcase with its center axis vertically extended, and provided with a belt-drive transmission mechanism including a lubricated rubber belt for transmitting the power of the crankshaft to a driven device. The vertical internal combustion engine is incorporated into, for example, an outboard motor.

2. Description of the Related Art

A vertical internal combustion engine disclosed in, for example, JP-A 2-275020 is provided with a belt-drive transmission mechanism including a rubber belt for transmitting the power of the crankshaft to a driven device. The belt-drive transmission mechanism is placed in a belt chamber, and the rubber belt is lubricated with oil that flows from the crankcase into the belt chamber.

If the belt chamber is opened into the crankcase and the components of the belt-drive transmission mechanism including a belt and pulleys are exposed to the atmosphere in the crankcase, the belt is likely to be exposed to gas containing oil mist and blowby gases. Hereinafter, this gas will be referred to as "oil-containing gas". Moreover, the belt is wetted with oil drops splashed by the rotating crankshaft and with the oil adhered to the pulleys and scattered when the pulleys rotate. Consequently, the belt is excessively lubricated. If the belt is exposed excessively to the oil and blowby gases contained in the oil-containing gas and to the high-temperature oil-containing gas, components of the oil and the blowby gases accelerate the degradation of the rubber belt and shorten the life of the rubber belt. If the width and thickness of the belt is increased and the strength of the belt is enhanced to reduce the detrimental effect of degradation on the belt, the cost and size of the belt-drive transmission mechanism increase. If the belt is not satisfactorily lubricated, the belt is abraded by increased friction between the belt and the pulley and the life of the belt shortens.

SUMMARY OF THE INVENTION

The present invention has been made in view of those problems and it is therefore an object of the present invention to extend the life of a rubber belt included in a transmission mechanism incorporated into a vertical internal combustion engine by preventing the rubber belt from being excessively exposed to oil-containing gas from the crankcase of the vertical internal combustion engine. Another object of the present invention is to suppress contact between the rubber belt and oil collected on a bottom wall of the belt chamber.

To achieve the object, the present invention provides a vertical internal combustion engine comprising: a crankshaft enclosed in a crank chamber with a center axis thereof vertically extended; a driven mechanism including a driven shaft rotatively driven by the crankshaft; a belt-drive transmission mechanism held in a belt chamber and including a belt made of rubber for transmitting power of the crankshaft to the driven shaft and lubricated with oil; and a transmission case defining the belt chamber; wherein a shielding member is disposed between the crank chamber and the belt chamber, the belt has a part extending over the crank chamber, and the shielding member is disposed to screen the part of the belt from the crank chamber.

According to the present invention, the shielding member shields or screens the part of the belt overlapping the crank chamber, so that oil drops scattered in and flowing toward the crank chamber and oil mist in the oil-containing gas from the crank chamber are shielded or screened by the shielding member, so that oil drops and mist are prevented from excessively contacting the belt. In addition, it is also prevented that blowby gases in the oil-containing gas contacts the belt excessively. Consequently, deterioration of the belt due to contact with the oil and the blowby gases is suppressed, whereby the life of the belt can be extended and the maintenance period can be shortened.

In the vertical internal combustion engine, preferably, a vent hole connecting the crank chamber and the belt chamber is formed in a part of the shielding member not overlapping the part of the belt in a plane.

Since the a vent hole does not overlap the part of the belt extending over the crank chamber, the oil in the oil-containing gas entering the belt chamber through the vent hole is prevented from excessively contacting the belt, while ensuring proper lubrication of the belt.

DESCRIPTION OF THE PREFERRED EMBODIMENTS

FIGS. 1 to 4 illustrate a vertical internal combustion engine E in an embodiment of the present invention.

Figure 1:
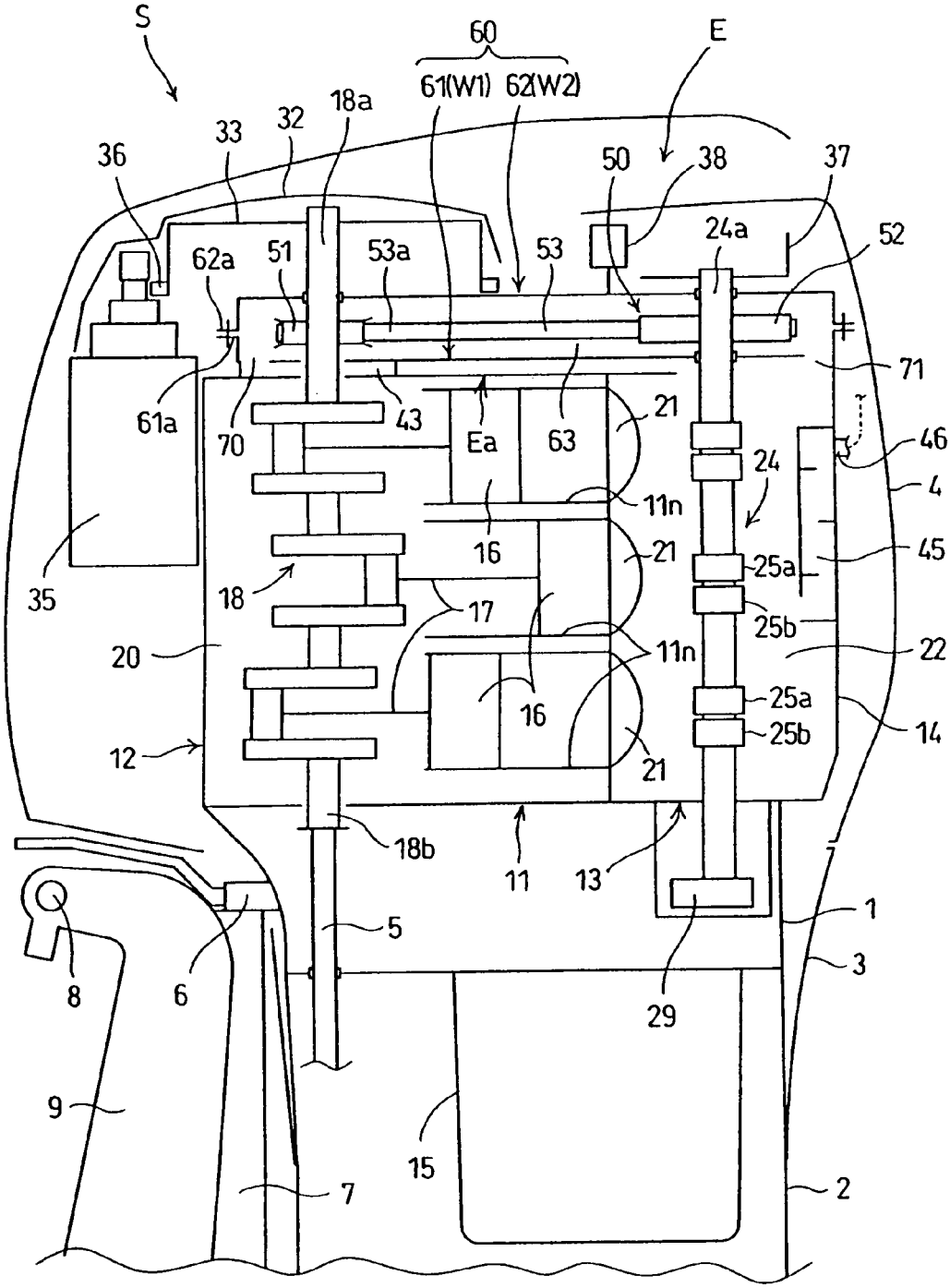
FIG. 1 is a schematic side elevation of an outboard motor provided with a vertical internal combustion engine in an embodiment of the present invention taken from the left side of the outboard motor.

Referring to FIG. 1, the vertical internal combustion engine E is incorporated into an outboard motor S. The outboard motor S includes the internal combustion engine E disposed with the center axis of its crankshaft 18 vertically extended, a mount case 1 supporting the internal combustion engine E, an extension case 2 joined to the lower end of the mount case 1, a gear case joined to the lower end of the extension case 2, an under cover 3 covering a part between a lower part of the internal combustion engine E and an upper part of the extension case 2, and an engine cover 4 joined to the upper end of the under cover 3.

The outboard motor S has a transmission mechanism including a drive shaft 5 coaxially connected to a lower end part 18*b* of the crankshaft 18, a reversing mechanism held in the gear case, and a propeller. The power of the internal combustion engine E is transmitted from the crankshaft 18 through the drive shaft 5 and the reversing mechanism to the propeller.

A mounting device for mounting the outboard motor S on the stern of a hull has a swivel shaft 6 fixed to the mount case 1 and the extension case 2, a swivel case 7 supporting the swivel shaft 6 for turning thereon, a tilting shaft 8 supporting the swivel case 7 so as to be turnable in a vertical plane, and a bracket 9 holding the tilting shaft 8 and attached to the stern of the hull. The mounting device holds the outboard motor S so as to be turnable on the tilting shaft 8 in a vertical plane relative to the hull and so as to be turnable on the swivel shaft 6 in a horizontal plane.

Figure 2:
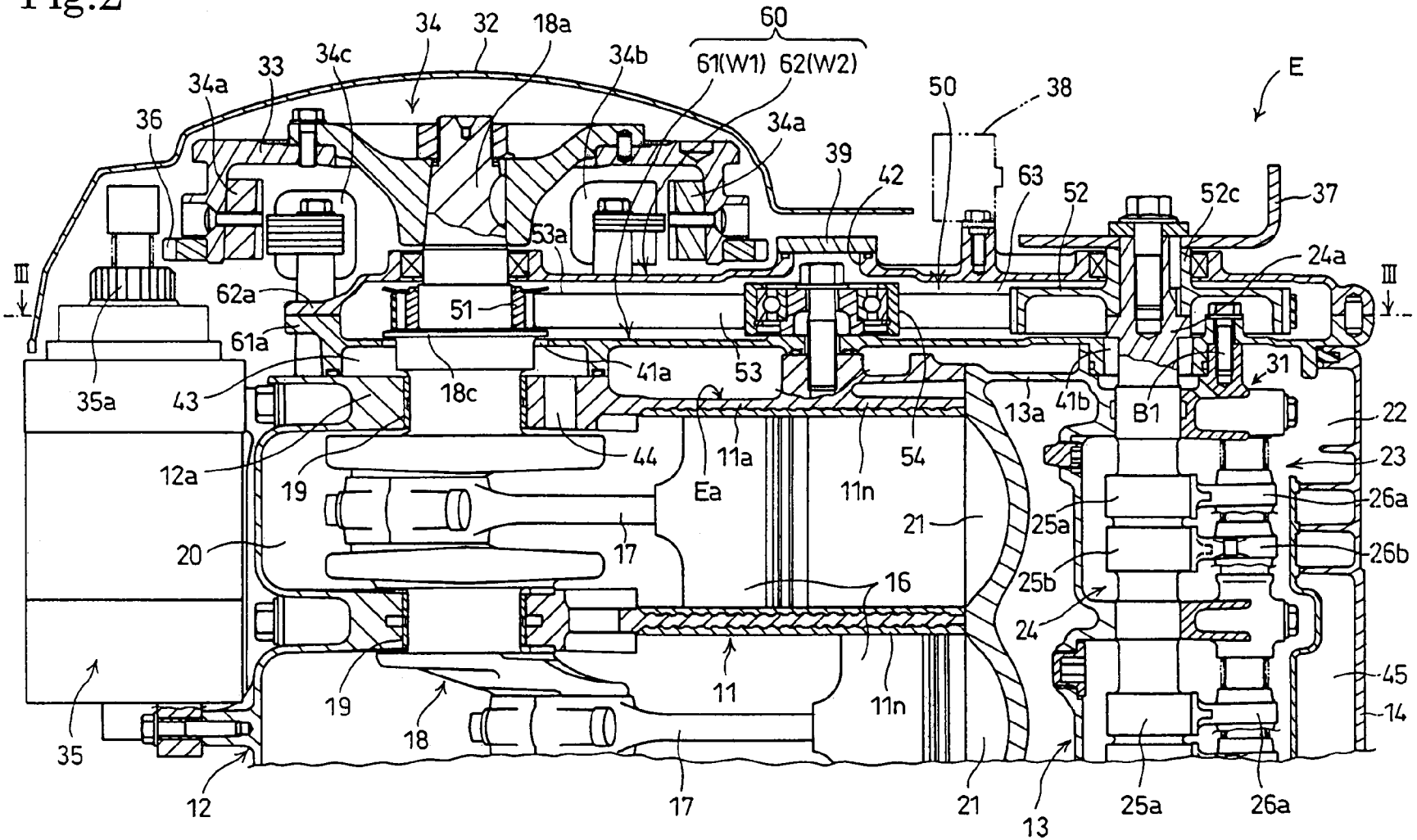
FIG. 2 is an enlarged sectional view of an essential part of the vertical internal combustion engine shown in FIG. 1.

Referring to FIGS. 1 and 2, the internal combustion engine E, which is a multi-cylinder 4-stroke internal combustion engine, has an engine body including a cylinder block 11 provided with three cylinders 11*n* arranged in a row in a vertical direction, a crankcase 12 joined to the front end of the cylinder block 11, a cylinder head 13 joined to the rear end of the cylinder block 11, and a head cover 14 joined to the rear end of the cylinder head 13, and an oil pan 15 placed in the extension case 2 and joined to the lower end of the mount case 1.

Pistons 16 are fitted in the cylinders 11*n* for reciprocation in the cylinders 11*n*, respectively. The pistons 16 are connected by connecting rods 17, respectively, to the crankshaft 18 placed in a crank chamber 20 defined by the cylinder block 11 and the crank-case 12. The vertical crankshaft 18 is supported for rotation in main bearings 19 on the cylinder block 11 and the crankcase 12 with its center axis extended substantially parallel to a vertical direction.

The cylinder head 13 is provided with combustion chambers 21 respectively opposed to the pistons 16 with respect to a direction parallel to the axes of the cylinders 11*n*, intake ports respectively opening into the combustion chambers 21, exhaust ports respectively opening into the combustion chambers 21, and spark plugs respectively facing the combustion chambers 21. The cylinder head 13 is provided with intake valves for opening and closing the intake ports, and exhaust valves for opening and closing the exhaust ports. The intake valves and the exhaust valves are driven for opening and closing operations in synchronism with the rotation of the crankshaft 18 by an overhead camshaft type valve train 23 disposed in a valve train chamber 22 defined by the cylinder head 13 and the head cover 14.

The valve train 23 includes a camshaft 24 provided with intake cams 25*a* and exhaust cams 25*b*, intake rocker arms 26*a* supported for rocking motions on a rocker arm shaft, and exhaust rocker arms 26*b* supported for rocking motions on a rocker arm shaft. The camshaft 24 is driven for rotation by the crankshaft 18 through a belt-drive transmission mechanism 50. The camshaft 24 has a center axis parallel to that of the vertical crankshaft 18. The intake valves and the exhaust valves are driven for opening and closing motions by the intake rocker arms 26*a* and the exhaust rocker arms 26*b* driven by the intake cams 25*a* and the exhaust cams 25*b*, respectively. The valve train 23 is a driven device provided with the camshaft 24, namely, a driven shaft, driven for rotation by the crankshaft 18.

Figure 3:
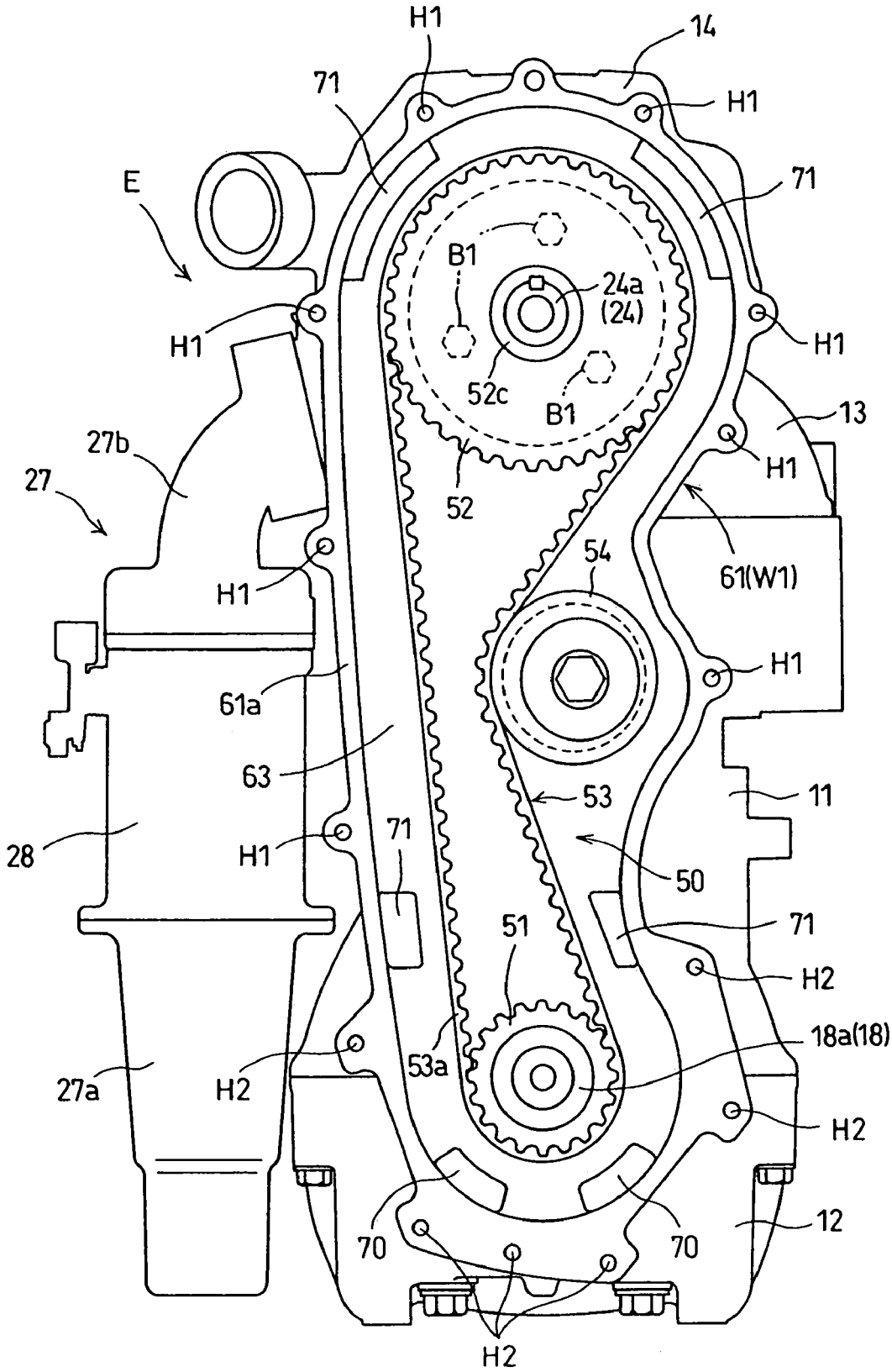
FIG. 3 is a sectional view taken on the line III-III in FIG. 2.

Referring also to FIG. 3, the internal combustion engine E has an intake system 27 including an inlet air silencer 27*a*, and an intake pipe 27*b* for carrying intake air taken in through the inlet air silencer 27*a* and metered by a throttle valve included in a carburetor 28 to the intake ports. The intake air that flows through an intake passage in the intake system 27 is mixed with fuel in a carburetor 28 for each cylinder 1 in to produce an air-fuel mixture. The air-fuel mixture is sucked through the intake pipe 27*b* and the intake port into the combustion chamber 21. Then, the air-fuel mixture is ignited by the spark plug and burns to produce a combustion gas. Thus the pistons 16 are reciprocated by the pressure of the combustion gas and drive the crankshaft 18 for rotation through the connecting rods 17.

The combustion gas discharged as exhaust gas from the combustion chambers 21 flows through the exhaust ports into an exhaust manifold passage formed in the cylinder block 11. Then, the exhaust gas is discharged through passages formed in the mount case 1, the exhaust pipe and the extension case 2 into the water.

The internal combustion engine E is provided with a lubrication system including the oil pan 15 placed below the cylinder block 11, the cylinder head 13 and the crankcase 12, an oil pump 29 (FIG. 1) driven by the camshaft 24 supported on the cylinder head 13, and oil passages. The oil pump 29 pumps up oil through a suction oil passage formed in the mount case 1, the cylinder block 11 and the cylinder head 13 from the oil pan 15. The oil discharged from the oil pump 29 flows through a discharge oil passage formed in the cylinder head 13 and the cylinder block 11 and an oil filter into a main oil gallery. The oil that has flowed into the main oil gallery is distributed through oil passages formed in the cylinder block 11, the cylinder head 13 and the crankshaft 18 to parts requiring lubrication including moving parts of the crankshaft 18 and the main bearings 19 in the crank chamber 20, and moving parts of the valve train 23 including the camshaft 24 and the rocker arms 26*a* and 26*b* in the valve train chamber 22. The used oil flows through return passages formed in the cylinder block 11, the cylinder head 13 and the mount case 1 and returns to the oil pan 15.

Referring to FIGS. 1 to 3, the belt-drive transmission mechanism 50 is disposed in a belt chamber 63 defined by a transmission case 60 included in the internal combustion engine E. The transmission case 60 has a lower case 61, namely, a first case, joined to the upper end $E_a$ of the engine body, and an upper case 62, namely, a second case, joined to the lower case 61. The lower case 61 forms a bottom wall W1, namely, a first wall, and the upper case 62 forms a top wall W2, namely, a second wall. The bottom wall W1 and the top wall W2 defines the belt chamber 63. The respective flanges 61*a* (FIG. 2) and 62*a* (FIG. 2) of the lower case 61 and the upper case 62 are joined together in an oil-tight fashion with bolts not shown, passed through holes formed in the upper case 762 and screwed into threaded holes H1 (FIG. 3) formed in the lower case 61, and bolts, not shown, passed through through holes H4 formed in the upper case 62 and through holes H2 formed in the lower case 61 and screwed into threaded holes formed in respective upper end parts 11*a* and 12*a* (FIG. 2) of the cylinder block 11 and the crankcase 12. The lower case 61 is fastened to an upper end part 13*a* of the cylinder head 13 with bolts B1 and connected to the upper end part 13*a* by a camshaft holder 31. The upper end parts 11*a*, 12*a* and 13*a* form an upper end part $E_a$ of the engine body. The bottom wall W1 and the top wall W2 define the belt chamber 63.

The belt-drive transmission mechanism 50 includes a drive pulley 51, a driven pulley 52, a belt 53 made of rubber, namely, an endless toothed belt, and a tension pulley 54 (FIG. 3). The drive pulley 51 is mounted in the belt chamber 63 on an upper end part 18*a* of the crankshaft 18 extended vertically upward through the lower case 61 and the upper case 62. The driven pulley 52 is mounted in the belt chamber 63 on an upper end part 24*a* of the camshaft 24 extended vertically upward through the lower case 61 and the upper case 62. The belt 53 is extended between the drive pulley 51 and the driven pulley 52 and is tensioned by the tension pulley 54.

Referring to FIGS. 1 and 2, a part of the upper end part 18*a* of the crankshaft 18 projected upward from the upper case 62 is covered with a cover 32 attached to the upper case 61. An AC generator 34 is disposed in a space covered with the cover 32. The AC generator 34 includes a flywheel 33, permanent magnets 34*a* attached to the flywheel 33, an exciter coil 34*b* for ignition fixedly held on the upper end Ea of the engine body, and a charging coil 34*c*. A ring gear 36 is attached to the circumference of the flywheel 33. A pinion 35*a* mounted on the drive shaft of a starting motor 35 is brought into mesh with the ring gear 36. A pulser rotor 37 is mounted on the upper end part 24*a* of the camshaft 24. A pulser coil 38 for generating a pulse signal indicating an angular position of the camshaft 24 is attached to the upper case 62.

The upper case 62 is provided with openings through which the upper end parts 18*a* and 24*a* and the boss 52*c* of the driven pulley 52 are extended, and a hand hole 42 for adjusting the position of the tension pulley 54. The hand hole 42 is covered with a cover 39. Joints between the upper end parts 18*a* and 24*a* and the boss 52*c* and the openings are sealed in an oil-tight fashion.

Referring to FIGS. 2 and 3, the lower case 61 disposed between the crank chamber 20 and the belt chamber 63 with respect to the vertical direction is provided with opening 41*a* and 41*b* through which the upper end parts 18*a* and 24*a* are passed, respectively, crank chamber vent holes 70 opening into the crank chamber 20, and valve train chamber vent holes 71 opening into the valve train chamber 22. The vent holes 70 open into a space 43 between the lower case 61 and the respective upper end parts 11*a* and 12*a* of the cylinder block 11 and the crankcase 12. The vent holes 70 communicate with the crank chamber 20 by way of a connecting passage 44 formed in the upper end 11*a*. A part of the lower case 61 around the opening 41*a* is joined to the cylinder block 11 and the crankcase 12 in an oil-tight fashion. A part of the lower case 61 around the opening 41*b* is joined to the cylinder head 13 and the camshaft holder 31 in an oil-tight fashion.

The circular opening 41*a* is slightly greater than a circular flange 18*c* formed on the upper end part 18*a* of the crankshaft 18. Therefore, the flow of the gas between the crank chamber 20 and the belt chamber 63 through the opening 41*a* is very small and negligible as compared with the flow of the gas through the vent holes 70 and 71. Thus the gas flows between the crank chamber 20 and the belt chamber 63 substantially only through the vent holes 70, and the gas flows between the valve train chamber 22 and the belt chamber 63 substantially only through the vent holes 71.

The vent holes 70 and 71 lie below the belt 53. Suppose that the belt chamber 53 is divided into an inside area surrounded by the belt 53 and an outside area extending outside the belt 53 in a horizontal plane. The vent holes 70 and 71 are formed in the outside area, namely, an area extending between the belt-drive transmission mechanism 50 and the flange 61*a*. Therefore, the vent holes 70 and 71 do not overlap the belt-drive transmission mechanism 50 in a horizontal plane. Thus the lower case 61 serves as a shielding member or a partition wall entirely or substantially entirely isolating an overlying part of the belt-drive transmission mechanism 50 overlying the crank chamber 20 from the crank chamber 20 as viewed in a vertical direction or in a horizontal plane, and the vent holes 70 and 71 do not overlap the overlying part of the belt-drive transmission mechanism 50 corresponding to the crank chamber 20 as viewed in a horizontal plane. In this embodiment, the overlying part of the belt-drive transmission mechanism 50 includes at least a part 53*a* (FIG. 1) of the belt 53 overlying the crank chamber 20 in a plane containing the belt 53 among the components of the belt-drive transmission mechanism 50.

Referring to FIGS. 1 and 2, a breather structure for carrying blowby gases from the crank chamber 20 into the intake system 27 has a wall defining a breather chamber 45 in the valve train chamber 22, and a breather pipe 46 (FIG. 1) connecting the breather chamber 45 to the inlet air silencer 27*a*. The breather chamber 45 has an upstream part communicating with the valve train chamber 22, and a downstream part connected to the breather pipe 46. Blowby gases flow through the breather chamber 45 into the intake passage.

More concretely, the crank chamber 20 contains therein oil drips and oil mist produced from oil splashed by the rotating crankshaft 18 and oil discharged from the main bearings 19, and blowby gases. An oil-containing gas, namely, a mixture of blowby gases and oil mist, is drawn from the crank chamber 20 through internal breather passages, not shown, formed in the cylinder block 11 and the cylinder head 13 into the valve train chamber 22 by intake manifold vacuum created in the breather chamber 45 while the internal combustion engine E is running. In the meantime, part of the oil-containing gas flows from the crank chamber 20 through the connecting passage 44, the space 43 and the vent holes 70 into the belt chamber 63, and then flows from the belt chamber 63 through the vent holes 71 into the valve train chamber 22. Oil is separated from the oil-containing gas drawn into the valve train chamber 22 in the breather chamber 45 to produce a gas not containing oil. The gas not containing oil flows from the breather chamber 45 through the breather pipe 46 into the inlet air silencer 27*a*. Then, the gas is taken together with intake air into the combustion chambers 21.

The oil mist contained in the oil-containing gas that flows from the crank chamber 20 into the belt chamber 63 wets the components of the transmission mechanism 50 including the belt 53 and the pulleys 51 and 52 within the belt chamber 63. Thus the belt 53 and the pulleys 51 and 52 are lubricated. Oil drops scattered in the crank chamber 20 are blocked off by the lower case 61, so that the oil drops are restrained from adhering to the components of the transmission mechanism 50 including the belt 53.

The oil-containing gas flowing from the crank chamber 20 toward the belt chamber 63 hits against the lower case 61 in the space 43. Consequently, the flow of the oil-containing gas is deflected such that the oil-containing gas from the crank chamber 20 flows in directions deviating from a direction toward the belt chamber 63, and then flows through the vent holes 70 into the belt chamber 63. When the oil-containing gas hits against the lower case 61, part of the oil contained in the oil-containing gas separates from the oil-containing gas and adheres to the lower case 61, so that the oil content of the oil-containing gas is reduced.

Therefore, the belt chamber 63 is isolated from the crank chamber 20 in such a manner that the oil-containing gas from the crank chamber 20 is deviated from the transmission mechanism 50 including the belt 53, so that the transmission case 60 constitutes an isolating wall isolating the belt chamber 63 from the transmission case 60.

The operations and effects of the internal combustion engine E will be described.

The transmission case 60 forming the belt chamber 63 in the internal combustion engine E has the lower case 61 (or the bottom wall W1). The lower case 61 serves as a screening member for screening the belt chamber 63 from the crank chamber 20. The lower case 61 screens the part 53*a* (FIG. 1) of the belt 53 extending over the crank chamber 20 from the crank chamber 20. The lower case 61 screens the belt 53 from oil drops scattered out from the crank chamber 20 and oil-containing gas flowing out from the crank chamber 20. Thus the belt 53 is prevented from being excessively wetted with oil drops and oil mist contained in the oil-containing gas and from being excessively exposed to blowby gases contained in the oil-containing gas. As a result, deterioration of the belt 53 due to contact with the oil and the blowby gases is suppressed, the life of the belt 53 lubricated by the oil in the oil-containing gas is extended and maintenance period can be shortened.

The lower case 61 of the transmission case 60 serves as a screening member. Therefore, the internal combustion engine E does not need any special screening member, which reduces the number of component parts and the cost of the internal combustion engine E.

The lower case 61 is provided with the vent holes 70 and 71 formed in the outside part W1*b* of the bottom wall W1 not overlapping the part 53*a* of the belt 53 extending over the crank chamber 20 in a horizontal plane. Therefore, the belt 53 is prevented from being excessively wetted with the oil contained in the oil-containing gas flowing through the vent holes 70 and 71 into the belt chamber 63, while lubrication of the belt 53 is ensured by the oil within the oil-containing gas flowing into the belt chamber through the vent holes 70 and 71.

Embodiments in modifications of the foregoing embodiments will be described.

Figure 4:
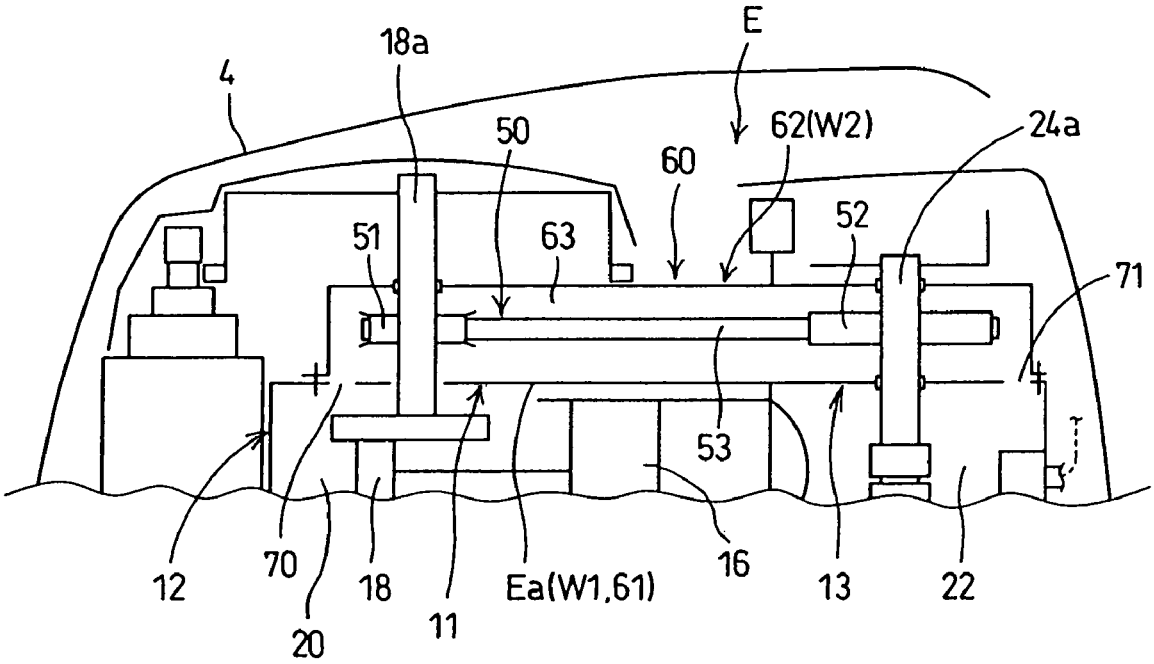
FIG. 4 is a schematic side elevation, similar to FIG. 1, showing another embodiment of the present invention.

As shown in FIG. 4, the lower case 61 (the bottom wall W1) is formed by the upper end part $E_a$ of the engine body, and the upper case 62 is joined to the upper end part $E_a$ to form the belt chamber 63. Since the upper end part $E_a$ serves also as the lower case 61, the number of component parts can be reduced, and the vertical dimension of the internal combustion engine can be reduced.

The driven device may be an auxiliary device, such as a rotary oil pump 29 or other power transmission mechanism.

A flywheel may be mounted on a lower end part 18*b* of the crankshaft 18 and the drive shaft 5 may be connected to the crankshaft 18 by the flywheel.

The belt chamber 63 may be disposed inside the engine body or may be disposed under the engine body instead of being disposed above the engine body.

The vertical internal combustion engine may be a single-cylinder internal combustion engine and may be incorporated into a machine other than the outboard motor.

What is claimed is:

1. A vertical internal combustion engine comprising:

a horizontally disposed engine body having a crankcase connected to a cylinder block and forming a crank chamber and a valve train chamber therein;

a crankshaft enclosed in the crank chamber with a center axis thereof vertically oriented and extending upward through an upper end part of the crankcase;

a driven mechanism including a driven shaft supported in the engine body with a center axis thereof vertically oriented, to be rotatively driven by the crankshaft, said driven shaft disposed in the valve train chamber;

a belt-drive transmission mechanism including a drive pulley mounted on an upper end part of the crankshaft, a driven pulley mounted on an upper end part of the driven shaft, and a rubber belt extending around the drive pulley and the driven pulley to transmit power of the crankshaft to the driven shaft;

and a transmission case joined to an upper part of the engine body and defining a belt chamber for enclosing the drive pulley, the driven pulley and the belt, said transmission case comprising an upper case and a lower case forming a bottom wall joined to the engine body, said transmission case defining a belt chamber therein and having vent holes formed through a portion of the lower case, through which the belt chamber is in communication with an interior of the engine body, said vent holes including crank chamber vent holes in fluid communication with the crank chamber and valve train chamber vent holes in communication with the valve train chamber;

wherein said engine body has a connecting passage formed through the upper end part of the crankcase to allow an oil-containing gas in the crank chamber to flow outwardly from the crank chamber, through the connecting passage and through the crank chamber vent holes into the belt chamber;

wherein the lower case is configured to allow said oil-containing gas to flow from the belt chamber downwardly through the valve train chamber vent holes into the valve train chamber;

and wherein said bottom wall of the lower case has an opening through which the crankshaft extends upward with a clearance, and the crankshaft has a flange which is formed on the crankshaft to rotate with the crankshaft and disposed adjacent to said opening and is so larger in size than the opening as to allow a small amount of the oil-containing gas to flow through said opening to thereby screen a part of the belt from the crank chamber.

2. The vertical internal combustion engine as claimed in claim 1, wherein the crank chamber vent holes for connecting the crank chamber and the belt chamber are formed through the bottom wall of the lower case, at positions spaced apart from and not overlapping the crankshaft and the drive pulley.

3. The vertical internal combustion engine as claimed in claim 1, wherein the crank chamber vent holes for connecting the crank chamber and the belt chamber are disposed adjacent to the crankshaft.

4. The vertical internal combustion engine as claimed in claim 1, wherein the vent holes through which the belt chamber is in communication with the interior of the engine body are arranged between a periphery of the bottom wall of the lower case and the belt-drive transmission mechanism.

5. The vertical internal combustion engine as claimed in claim 1, wherein a space is formed around the crankshaft between the bottom wall of the lower case and the upper end part of the crankcase, said space being in communication with said connecting passage and the vent holes for connecting the crank chamber and the belt chamber.

6. The vertical internal combustion engine as claimed in claim 1, wherein the lower case includes an outer portion disposed outside of the rubber belt, and the vent holes are spaced away from the rubber belt and formed through the bottom wall of said lower case in said outer portion.

* * * * *